United States Patent [19]

Ellingson et al.

[11] Patent Number: 4,473,827

[45] Date of Patent: Sep. 25, 1984

[54] ANTENNA TOWER ASSEMBLY AND METHOD FOR SUPPORTING ROTATING CARRIAGE

[75] Inventors: Gary L. Ellingson, Thief River Falls; LeRoy A. Kapsner, Little Falls, both of Minn.; Wendell E. Miller, Warsaw, Ind.

[73] Assignee: Polar Research, Inc., Thief River Falls, Minn.

[21] Appl. No.: 477,984

[22] Filed: Mar. 23, 1983

Related U.S. Application Data

[62] Division of Ser. No. 272,313, Jun. 10, 1981.

[51] Int. Cl.[3] ..... H01Q 1/12; H01Q 3/02

[52] U.S. Cl. ..... 343/766; 343/890

[58] Field of Search ..... 343/757, 758, 763, 766, 343/878–880, 882, 890, 893; 211/163; 52/65, 100, 114, 649, 653, 655

[56] References Cited

U.S. PATENT DOCUMENTS

| | | | |
|---|---|---|---|
| 2,290,692 | 7/1942 | Lindenblad | 343/879 |
| 2,605,417 | 7/1952 | Andrews | 211/163 |
| 2,623,999 | 12/1952 | Kulikowski | 343/758 |
| 2,642,754 | 6/1953 | De Conti | 74/504 |
| 2,654,031 | 9/1953 | Mullins et al. | 343/5 R |
| 3,146,452 | 8/1964 | Rose | 343/758 |
| 3,187,333 | 6/1965 | Ciotek et al. | 343/766 |
| 3,246,431 | 4/1966 | Faerber | 52/65 |
| 3,541,570 | 11/1970 | Onnigian | 343/704 |
| 3,546,699 | 12/1970 | Smith | 343/100 |
| 3,790,950 | 2/1974 | Smith et al. | 343/879 |
| 4,293,861 | 10/1981 | Winegard et al. | 343/766 |

FOREIGN PATENT DOCUMENTS

| | | | |
|---|---|---|---|
| 1466609 | 2/1969 | Fed. Rep. of Germany | 343/763 |
| 808961 | 2/1959 | United Kingdom | 343/DIG. 1 |

*Primary Examiner*—Eli Lieberman

*Attorney, Agent, or Firm*—Wendell E. Miller

[57] ABSTRACT

The present invention provides apparatus and method for mounting a plurality of vertically-spaced antennas (256 or 384) or other devices (262) to a tower (12) of the type having three tower legs (20a–20c), and for both separate and selective rotational positioning of the antennas or other devices. The preferred embodiment includes first (170 or 342), second (170 or 342), and third (204 or 320) support housings that are separately attached to the three tower legs, and an antenna-mounting ring (142 or 292) that circumscribes the tower, and that is rotatably attached to the support housings.

20 Claims, 10 Drawing Figures

ANTENNA TOWER ASSEMBLY AND METHOD FOR SUPPORTING ROTATING CARRIAGE

This is a division of U.S. application Ser. No. 06/272,313, filed June 10, 1981.

The present invention relates generally to antenna tower assemblies, and more particularly to apparatus and methods for mounting and rotating a plurality of vertically-spaced antennas on a single antenna tower.

BACKGROUND ART

It is common practice to mount a plurality of separate antennas, which may include both receiving and transmitting antennas, on a single antenna tower. Further, it is traditional practice to mount one of the antennas on the top of the antenna tower and to rotate the one antenna by means of an electric motor and gear reducer. The remainder of the antennas are then mounted to the face of the antenna tower at various heights thereto. Thus only one antenna, that is, the antenna which is mounted to the top of the tower, is rotatable, and the remainder of the antennas are fixedly secured to the antenna tower.

Alternately, several antennas are mounted to one antenna rotator on the top of the antenna tower. This method of mounting has the disadvantage that all antennas must be rotated together, thus greatly diminishing the usefulness of the various antennas. Also, this method of mounting is limited in the type and number of antennas that can be rotated because of structural limitations.

When it has been desirable, or necessary, to rotate one of the face-mounted antennas, it has been customary to attach this antenna to the antenna tower by means of an outrigger, or side arm, that extends longitudinally out from the antenna tower. When the antenna tower consists of three vertically-disposed tower legs and truss bracing, it has been customary to construct this side arm from a section of the tower material.

This face-mounted antenna is then mounted at the outer end of the side arm by means of a second electric motor and gear reducer. This type of mounting for a rotatable antenna is highly unsatisfactory because of the effect of the metal in the antenna tower. That is, when this face-mounted and rotatable antenna is directed so that the antenna tower is directly behind the antenna, the antenna may be tuned for high performance. However, as the antenna is rotated to an angle where the antenna tower is to one side or the other of the antenna, the tuning of the antenna will be adversely affected. Further, as the antenna is rotated farther, not only will the tuning of the antenna further deteriorate, but also, the direction-sensing ability of the antenna will be adversely affected. That is, if this rotatable antenna is used as a search antenna, false directional readings will be indicated. Then, as the antenna is rotated to face the antenna tower, its tuning will be degraded even more, making the antenna highly ineffective either for transmission or receiving of radio frequencies.

Alternately, face-mounted antennas have been rotated by rotating the entire antenna tower. Of course, this requires an extremely large, heavy, and costly mechanism, is practical only for relatively short antenna towers of the non-guy-wired type, and has the additional disadvantage that all antennas are rotated simultaneously.

Kulikowski, in U.S. Pat. No. 3,623,999, shows an antenna that is mounted to a sleeve which is disposed coaxially around an antenna tower of the tubular mast type, and that is rotated by an electric drive motor. Kulikowski teaches a method of conductance coupling of the antenna to the lead-in conductors; but he does not address the technical problems of providing a workable rotating mount for face-mounting antennas to an antenna tower.

In particular, Kulikowski does not show, disclose, claim, or even intimate the need for, nor solutions for: vertically supporting the antenna, radially guiding the antenna, guiding against sideward tipping of the antenna-mounting ring, counterbalancing of torsional wind loads, use with towers of the trussed tower-leg type rather than the tubular mast type, electrical heating to overcome icing problems, or means for partially assembling the rotating device at ground level and then moving up past guy wires, all of which are advancements of the present invention.

DISCLOSURE OF INVENTION

In accordance with the broader aspects of this invention, there is provided an antenna tower assembly for the mounting and separately rotating of a plurality of vertically-disposed antennas on a single antenna tower.

In a preferred configuration, a single, two-piece antenna-mounting ring is mounted coaxially around an antenna tower of the type having three vertically-disposed tower legs. This antenna-mounting ring includes a V-shaped groove that is circumferentially disposed in an inner circumferential surface of the antenna-mounting ring.

Three support rollers, having vertically-disposed roller shafts, cooperate with upper and lower surfaces of the V-shaped groove in the antenna-mounting ring to rotatably support the antenna-mounting ring. Two of these support rollers are mounted to respective ones of two of the vertically-disposed tower legs by means of a support-roller assembly. A third one of the support rollers is mounted to the third of the tower legs by means of a support and drive assembly that includes an electric motor and gear reduction unit.

Preferably, the antenna-mounting ring includes a plurality of circumferentially-spaced gear teeth; and the roller shaft of the third support roller includes a drive pinion which meshes with the circumferentially-spaced teeth in the antenna-mounting ring and which is driven by the gear reduction unit.

In a second preferred embodiment, the roller shafts of the three support rollers are horizontally disposed; and the support rollers are frustoconical in shape. In this embodiment, the frustoconical support rollers engage a groove that is circumferentially disposed in the inner surface of the antenna-mounting ring. The antenna-mounting ring is rotated by a drive pinion whose shaft is horizontally disposed below one of the roller shafts and which engages circumferentially-spaced gear teeth on the antenna-mounting ring. These circumferentially-spaced gear teeth are disposed separate from and below the circumferential groove in the antenna-mounting ring.

BEST MODE FOR CARRYING OUT THE INVENTION

Figures 1, 2:
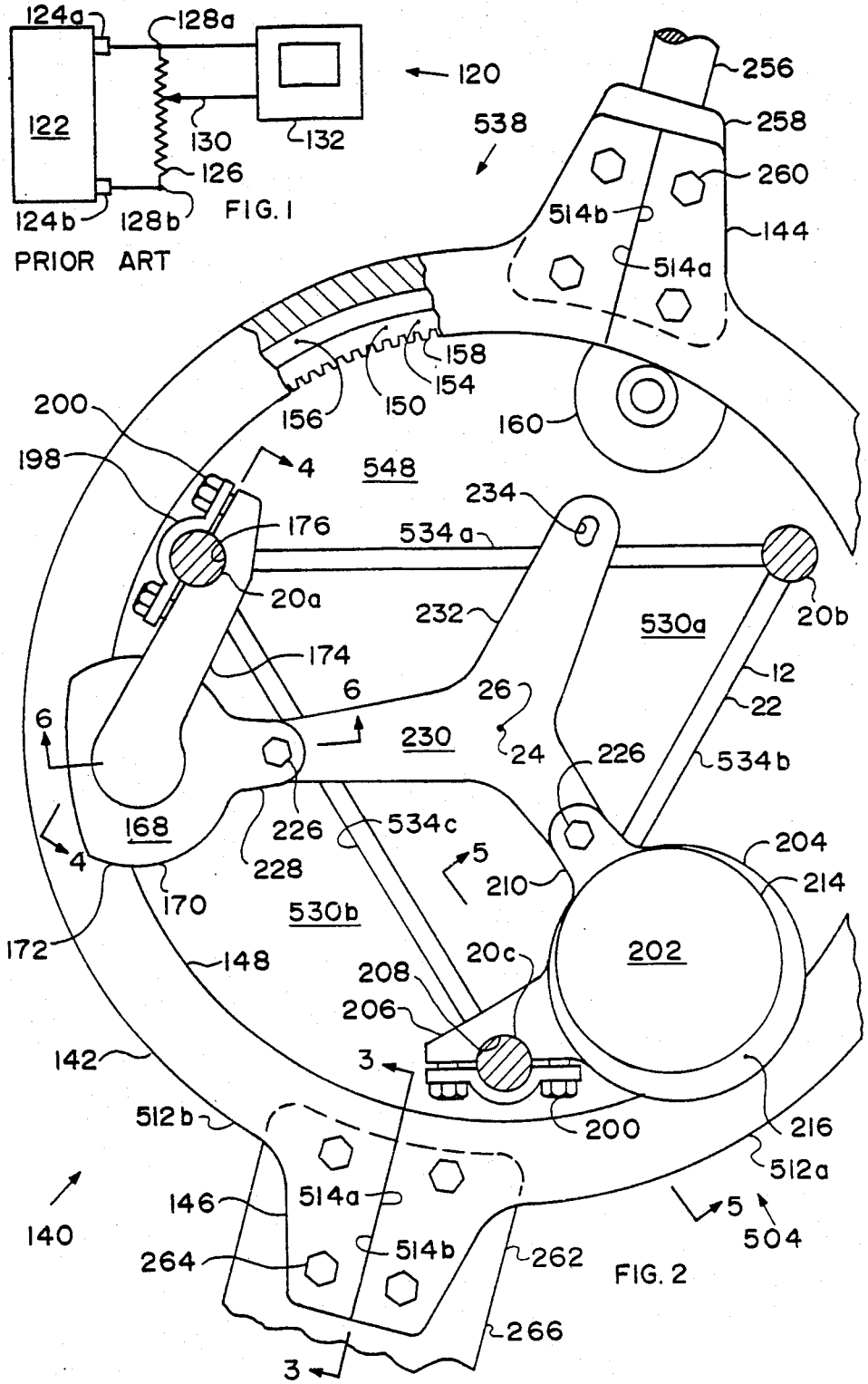
FIG. 1 PRIOR ART
FIG. 1 is a schematic drawing of a direction-indicating device for the embodiments of the succeeding figures.
FIG. 2 is a top plan view of a preferred embodiment in which the roller shafts for the support rollers are vertically disposed.

Referring now to the drawings and more particularly to FIG. 1, each of the antenna tower assemblies that will be subsequently described includes a position indicator 120. The position indicator 120 includes a regulated power supply 122 having output terminals 124*a* and 124*b*, a potentiometer 126 having legs 128*a* and 128*b* that are connected respectively to the output terminals 124*a* and 124*b* and having an arm 130, and an electrical meter 132 that is connected to the leg 128*a* and to the arm 130 of the potentiometer 126. The potentiometer 126 schematically represents a ten-turn potentiometer, such as is common in the electronics industry.

The use of a ten-turn potentiometer, and an electrical circuit, such as is shown in FIG. 1, to indicate the rotational position of an antenna, is common to the art.

Figure 6:
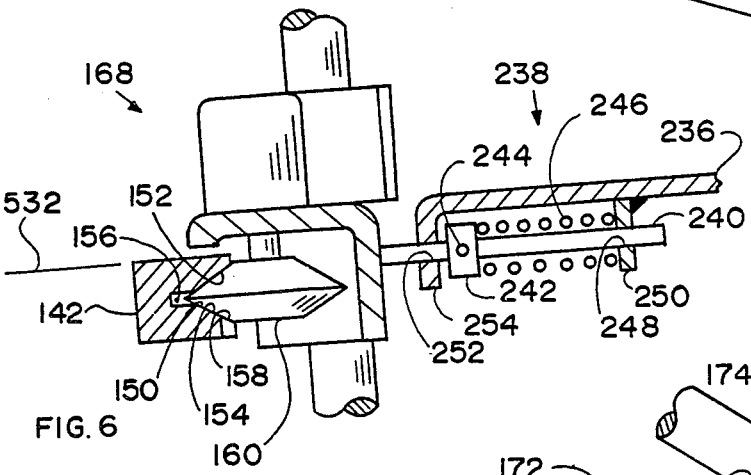
FIG. 6 is a cross-sectional view, taken substantially as shown by section line 6—6 of FIG. 2, showing a modificiation of the support roller assembly wherein the support roller is resiliently urged into contact with the antenna-mounting ring by a spring.

Referring now to FIGS. 2 and 6, an antenna tower assembly 140 comprises an antenna tower 12 having vertically-disposed tower legs, 20*a*–20*c*, and truss bracing 22. The antenna tower assembly 140 further comprises an antenna-mounting ring 142 having an antenna-attaching lug 144, a counterbalance and wind vane attaching lug 146, a circumferential inner surface or circumferential ring surface 148, a V-shaped circumferential groove 150 that includes an upper groove surface or upper circumferential surface 152, and a lower groove surface or lower circumferential surface 154, a relief groove 156, and a plurality of circumferentially-spaced gear teeth 158.

Figure 4:
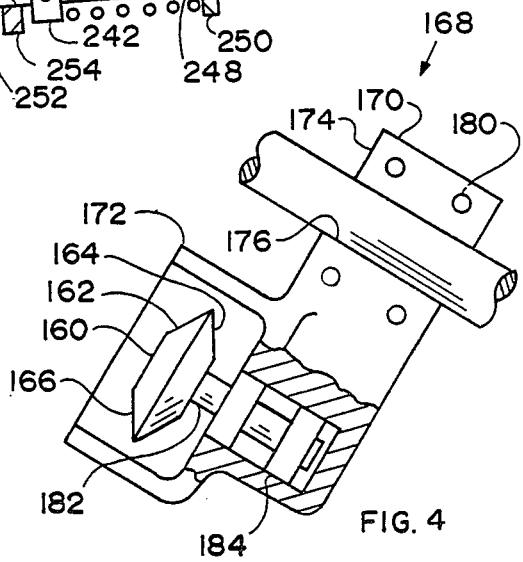
FIG. 4 is a partial side elevation, taken substantially as shown by view line 4—4 of FIG. 2, showing a support roller assembly.

The antenna-mounting ring 142 is supportingly, guidingly, and rotatably attached to the antenna tower 12 by three support rollers such as a support roller 160 of FIGS. 2, 4, and 6.

Referring now to FIG. 4, the support roller 160 includes a wedge-shaped circumferential surface 162 having an upper circumferential support surface 164 that supportingly engages the upper groove surface 152, and having a lower circumferential guide surface 166 that cooperates with the lower groove surface 154 to prevent tilting of the antenna-mounting ring 142.

Referring now to FIGS. 2 and 4, a support roller assembly 168 includes a support housing 170 having a bell-shaped shield 172, a mounting arm 174 having a cylindrical recess 176 therein, and threaded holes 180. The support roller 160 includes a roller shaft 182 which is secured in the housing 170 by longitudinally-spaced ball bearings 184.

Figure 7:
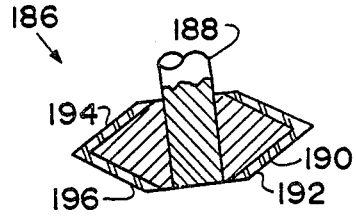
FIG. 7 is an enlarged and partial view of a support roller, taken substantially as shown in FIG. 6, showing a resilient drive surface which may be used in place of the drive pinion of FIG. 5.

Referring now to FIG. 7, in an optional configuration, a support roller 186 includes roller shaft 188. The support roller 186 also includes a roller body 190 which is preferably fabricated from steel, and a resilient cover 192 of molded rubber. Thus, the support roller 186 includes a resilient upper or support surface 194 and a resilient lower or guide surface 196.

Referring again to FIGS. 2 and 4, one of the support roller assemblies 168 is attached to the tower leg 20*a* by a bracket 198 and by bolts 200 that threadably engage the threaded holes 180. A support roller assembly, not shown, which is identical to the support roller assembly 168, is attached to the tower leg 20*b*, the support roller 160 thereof being illustrated.

Figure 5:
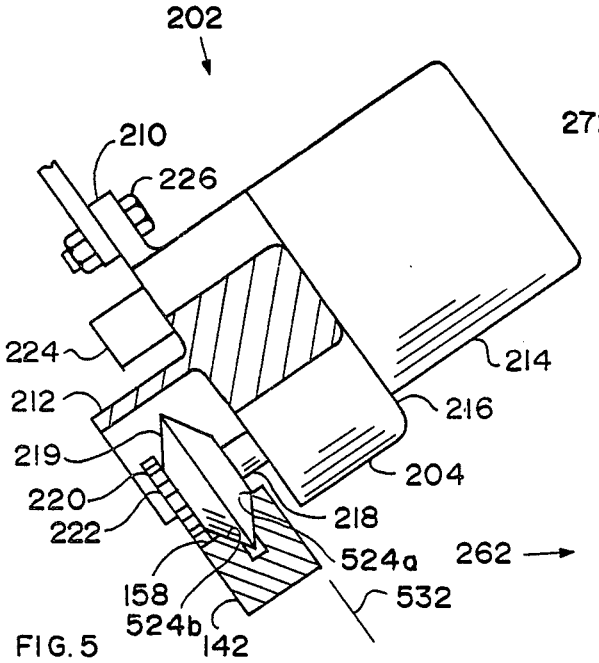
FIG. 5 is a cross-sectional view, taken substantially as shown by section line 5—5 of FIG. 2, showing the support and drive assembly.

Referring now to FIGS. 2 and 5, a support and drive assembly 202 includes a support housing 204 having a mounting arm 206 with a cylindrical recess 208 therein, having an adjusting lug 210, and having a shield portion 212.

The support and drive assembly 202 includes an electric drive motor and gear reducer unit 214 that is attached to a surface 216 of the housing 204 and that is attached to a roller shaft 218. The roller shaft 218 projects through the housing 204.

The support and drive assembly 202 also includes a support roller 219 which is identical to the support roller 160 of FIG. 12 except that the support roller 219 includes the roller shaft 218; and so the support roller 219 includes all of the surfaces as previously described for the support roller 160.

The support and drive assembly 202 also includes a toothed drive pinion 220 that is coaxially attached to the roller shaft 218 and that includes gear teeth 222 which progressively mesh with the gear teeth 158 of the antenna-mounting ring 142.

Finally, the support and drive assembly includes a ten-turn potentiometer 224 that is driven by the electric motor and gear reducer unit 214. The potentiometer 224 and the connection thereof to the electric drive motor and gear reducer unit 214 are conventional and do not comprise an inventive part of the present invention.

Referring now to FIG. 2, the support roller assembly 168 may be rotationally positioned about the tower leg 20*a* by loosening the bolts 200 and a bolt 226 that attaches an adjusting lug 228 of the housing 170 to a spider plate 230. The spider plate 230 includes three legs 232, each of which includes an elongated adjusting hole 234. In like manner, the support and drive assembly 202 may be rotationally positioned about the tower leg 20*c* by loosening the bolts 200 and the bolt 226.

Referring again to FIGS. 2 and 4–6, when any one of the support rollers 160 or 219 is rotationally positioned about the respective one of the tower legs, 20*a*–20*c*, providing close proximity between all the guide surfaces 166 of the support rollers 160 or 219 and the lower groove surface 154 of the antenna-mounting ring 142, the gear teeth 222 of the drive pinion 220 engage the gear teeth 158 of the antenna-mounting ring 142 with proper backlash.

Referring now to FIGS. 2, 6, and 7, alternately, the spider plate 230 may be modified to provide one leg 236 that includes a spring tension device 238. The spring tension device 238 includes a cylindrical rod 240, a collar 242 which is attached to the rod 240 by a transverse pin 244, and a spring 246. The rod 240 is inserted through a hole 248 in a lug 250 and through a hole 252 in a lug 254, the lug 250 being welded to the leg 236 as shown and the lug 254 being integral with the leg 236. In this modification, the bolts 200 are left slightly loose or shims, not shown, are placed between the bracket 198 and the arm 174 so that the bolts 200 can be tightened without the cylindrical recess 176 being tightened against the tower leg 20*a*.

Therefore, rather than the spider plate 230 being attached to the housing 170 by the lug 228, the rod 240 presses against the housing 170 and resiliently urges the housing 170 to rotate outwardly about the antenna tower leg 20*a*, thereby resiliently urging the support roller 160 thereof into resilient engagement with both the upper groove surface 152 and the lower groove surface 154 of the V-shaped groove 150.

In this adaptation, preferably, the toothed drive pinion 220 and the circumferentially-spaced gear teeth 158 are deleted and the support roller 186, with the resilient surfaces 194 and 196, is used to drive the antenna-mounting ring 142 by friction engagement of the resilient surfaces 194 and 196 with respective ones of the groove surfaces 152 and 154.

Figure 3:
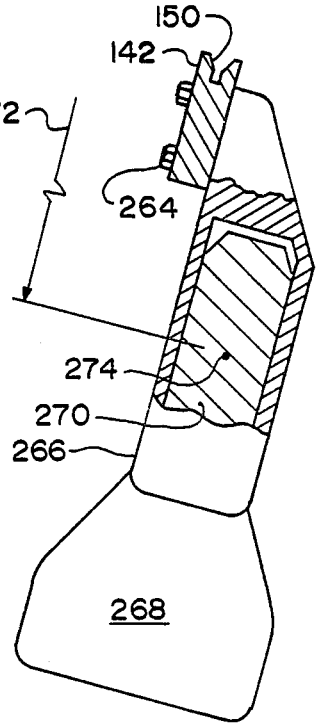
FIG. 3 is a cross-sectional view, taken substantially as shown by section line 3—3 of FIG. 2, showing in reduced scale, the counterweight and wind-vane assembly.

Referring now to FIGS. 2 and 3, an antenna 256 that includes an attaching lug 258 is attached to the lug 144 of the antenna-mounting ring 142 by bolts 260. In like manner, a counterbalance and wind vane assembly 262 is attached to the lug 146 by bolts 264. The counterbalance and wind vane assembly 262 includes a housing 266, a wind vane or wind-resisting member 268, and a counterbalance weight 270 that is retainably inserted into the housing 266.

The wind-resisting member 268 is sized and proportioned to provide a wind-resisting force and torque balance to match and counteract the wind-resisting force and torque applied to the antenna tower 12 by the antenna 256; and the counterbalance weight 270 is sized to effectively counter-balance torque that is applied to the antenna-mounting ring 142 by the antenna 256.

That is, the product of the weight of the counter-balance weight 270 times a distance 272 from a neutral axis 26 of antenna tower 12 to a centroid 274 of the weight 270 is adjusted to substantially equal the weight of the antenna 256 times the distance (not shown) from the neutral axis 26 of the antenna tower 12 to the centroid (not shown) of the weight of the antenna 256.

Figure 8:
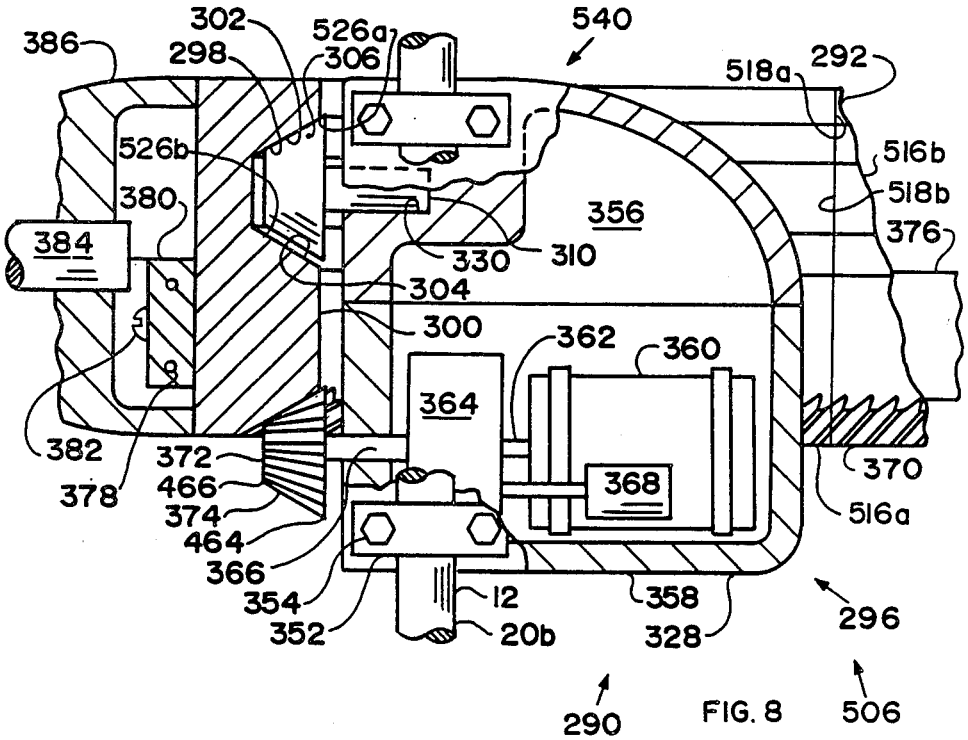
FIG. 8 is a cross-sectional view of an embodiment in which a support and drive assembly is secured to one of the tower legs, the support roller thereof rotates about a horizontally and radially-disposed axis, and the electric drive motor is fixedly secured with respect to the antenna tower.
Figure 10:
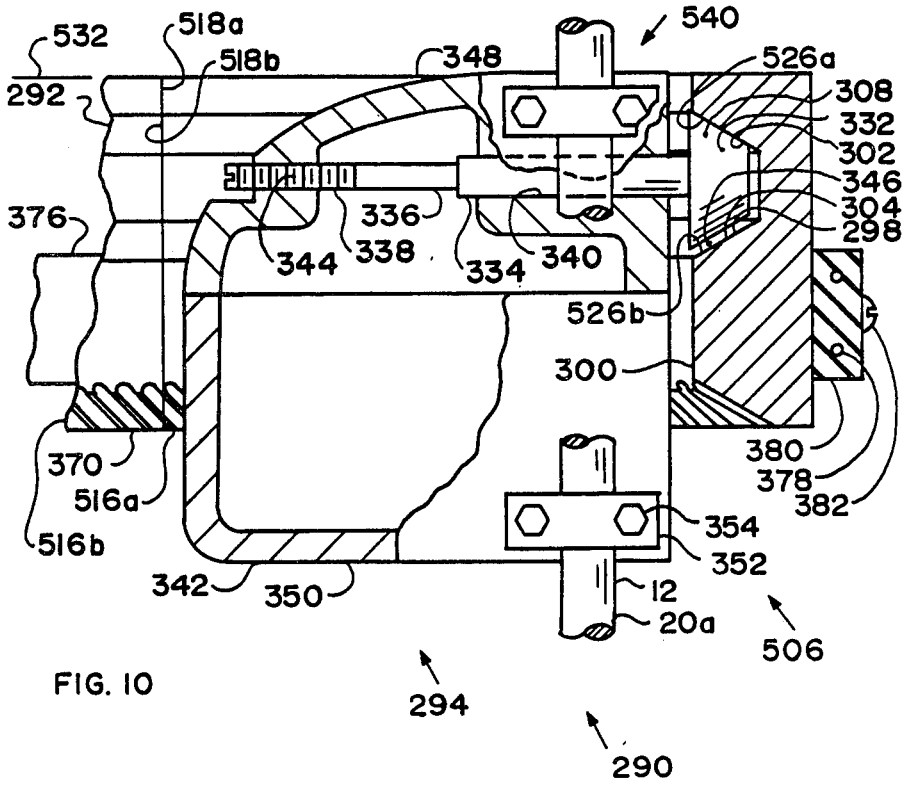
FIG. 10 is an enlarged and cross-sectional view of the support roller and bearing assembly for the embodiment of FIGS. 8 and 9.

Referring now to FIGS. 8 and 10, an antenna tower assembly 290 includes an antenna tower 12 having vertically-disposed tower legs 20*a* and 20*b* and a third vertically-disposed tower leg (not shown), an antenna-mounting ring 292 that is circumferentially disposed around the antenna tower 12, a support roller assembly 294 that is attached to the tower leg 20*a*, a support and drive assembly 294 that is attached to the tower leg 20*b*, and a second support roller assembly (not shown) that is identical to the support roller assembly 294 and that is attached to a third tower leg (not shown).

The antenna-mounting ring 292 includes a V-shaped groove 298 that is circumferentially disposed in a circumferential inner surface or circumferential ring surface 300 of the antenna-mounting ring 292. The groove 298 includes an upper groove surface or upper circumferential surface 302, and a lower groove surface or lower circumferential surface 304.

Figure 9:
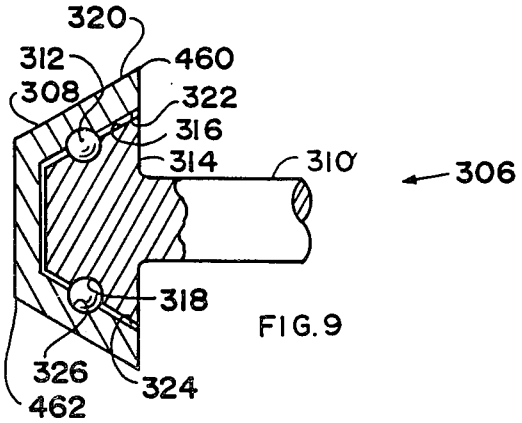
FIG. 9 is a cross-sectional view of a support roller assembly for the embodiment of FIG. 8.

Referring now to FIGS. 8 and 9, and more particularly to FIG. 9, a roller and bearing assembly 306 includes a support roller 308, a roller shaft 310, and a plurality of circumferentially-disposed steel balls 312. The roller shaft 310 includes an enlarged portion 314 having a frustoconical surface 316 and a circumferential ball groove 318 that is disposed in the surface 316. The support roller 308 includes a frustoconical outer surface 320, a bore 322 having a frustoconical inner surface 324, and a circumferentially-disposed ball groove 326 in the inner surface 324. The balls 312 are circumferentially disposed in the grooves 318 and 326, thereby providing an integral ball bearing between the support roller 308 and the roller shaft 310.

The roller shaft 310 is attached to a support housing 328 of the support and drive assembly 296 by inserting the roller shaft 310 into a bore 330 of the housing 328.

Referring now to FIG. 10, the support roller assembly 294 includes a roller and bearing assembly 332 that is identical with the roller and bearing assembly 306 except that the roller and bearing assembly 332 includes a longer roller shaft 334 and an integral adjusting screw 336 with a threaded portion 338.

The roller shaft 334 is slidably and rotatably received into a bore 340 of a support housing 342 of the support roller assembly 294; and the threaded portion 338 is threadingly received into a threaded bore 344 of the housing 342. Thus rotation of the adjusting screw 336 is effective to radially adjust the support roller 308; and radial adjustment of the support roller 308 is effective to control a clearance 346 between the support roller 308 and the lower or guide surface 304 of the antenna-mounting ring 292.

The housing 342 of the support roller assembly 294 includes an upper housing portion 348 and a lower housing portion 350 which are interoonnected by any suitable means.

The support roller assembly 294 is attached to the tower leg 20*a* of the antenna tower 12 by brackets 352 and bolts 354.

The housing 328 of the support and drive assembly 296 includes an upper housing portion 356 and a lower housing portion 358 that are interconnected by any suitable means. An electric drive motor 360 having an output shaft 362 is mounted in the lower housing portion 358. A gear reducer unit 364 is mounted in the lower housing portion 358, is attached to the output shaft 362 of the electric drive motor 360 and includes an output shaft 366. Also a ten-turn potentiometer 368 is mounted in the lower housing portion 358 and is connected to and driven by the gear reducer unit 364.

The antenna-mounting ring 292 includes a plurality of circumferentially-spaced gear teeth 370; and the support and drive assembly 296 includes a bevel gear or toothed drive pinion 372 being coaxially mounted onto the output shaft 366 and having gear teeth 374 that progressively mesh with the gear teeth 370 as the drive pinion 372 is rotated by the electric drive motor 360 and rotates the antenna-mounting ring 292.

The support and drive assembly 296 is attached to the tower leg 20*b* by brackets 352 and bolts 354.

Referring again to FIGS. 8 and 9, an electrical resistance heating unit 376 which includes an electrical resistance unit 378 and a molded body 380 of dielectric material is circumferentially disposed around the antenna-mounting ring 292 and is attached thereto by screws 382. The antenna tower assembly 290 further includes an antenna 384 that is attached to the antenna-mounting ring 292 by a housing 386.

Referring now to FIGS. 2, 3, 8, and 10, preferably, a counterbalance weight, such as the counterbalance weight 270 of FIG. 3 and a wind-resisting member such as the wind vane 268 of FIG. 3 are attached to the antenna-mounting ring 292 at a point circumferentially spaced from the housing 386. The counterbalance and wind vane assembly 262 of FIGS. 8 and 10 may be attached to the antenna-mounting ring 292 in the same manner as is shown for attaching the counterbalance and wind vane assembly 262 to the antenna-mounting ring 142 of FIGS. 2 and 3, or by the use of an additional housing identical to the housing 386. The detailed construction of the counterbalance and wind vane does not form an inventive part of the present invention.

In summary, the embodiment of FIGS. 8–10 differs from the embodiment of FIGS. 2–7 in that the roller shafts 210 and 334 of FIGS. 8 and 10 are horizontally disposed whereas the roller shafts 182 and 218 of FIGS. 2–7 are vertically disposed. The embodiment of FIGS. 8 and 10 also varies from the embodiment of FIGS. 2–7 in that the clearance 346 between the support rollers 308 and the lower surface 304 of the V-shaped groove 302 is by means of the adjusting screw 336 whereas clearance between the rollers 166 and 219 and the lower surface 154 of the groove 150 of the embodiment of FIGS. 2–7 is by means of rotationally positioning the support roller assembly 168 or the support and drive assembly 202 about one of the tower legs 20*a* or 20*c*.

Similarities between the embodiment of FIGS. 8 and 10 and the embodiment of FIGS. 2–7 include the mounting of three support rollers to respective ones of three antenna tower legs and both supporting and guiding an antenna-mounting ring by engagement of support and guide surfaces of support rollers with support and guide surfaces of a groove that is circumferentially disposed in the antenna-mounting ring.

In the present invention, a tower-attaching ring, an antenna-mounting ring, or any other ring or arcuate segment, may be built or assembled as a tower-retaining ring. Thus, whether the tower-retaining ring is a tower-attaching ring or an antenna-mounting ring, it is assembled to the tower 12, at any convenient height position, by moving a first arcuate segment transversely toward the tower 12 and into an arcuate relationship with the tower 12, by moving a second arcuate segment transversely toward the tower 12 and into tower-encircling relationship with the first arcuate segment, and by interconnecting ends of the arcuate segments.

Referring now to FIGS. 2–7, the method of rotatably mounting an antenna 256 to an antenna tower 12 having three vertically-disposed tower legs, 20*a*–20*c*, comprises attaching one of the support housings 170 to each of two of the tower legs, 20*a* and 20*b*, attaching the support housing 204 to the tower leg 20*c*, placing the antenna-mounting ring 142 around the tower 12, rotatably connecting the ring 142 to the support housing 170 and to the support housing 204 by attaching the support rollers 160 and 219 to the housings 170 and 204, and attaching an antenna 256 to the ring 142.

Referring now to FIGS. 8–10, the method further includes electrically heating the antenna-mounting ring or second mounting portion 292 by the use of an electrical resistance heating unit 376, and then rotationally positioning the antenna 384 by use of the electric drive motor 360.

Referring now to FIGS. 2, 8, and 10, if respective ones of the antennas 256 or 384, and if respective ones of the antenna towers 12 are deleted from respective ones of the antenna tower assemblies 140 or 290, the respective antenna tower assemblies become rotationally positionable mounts 504 or 506 respectively.

Referring now to FIG. 2, the antenna-mounting ring 142 includes first and second arcuate segments 512*a* and 512*b*, each having first and second ends 514*a* and 514*b*. The arcuate segments 512*a* and 512*b* are positioned around the antenna tower 12 with the first ends 514*a* abutting the second ends 514*b*. The arcuate segments 512*a* and 512*b* may be interconnected by the attaching lug 258 and the bolts 260, and by the bolts 264 attaching the housing 266 to both of the arcuate segments 512*a* and 512*b*. However, the method and details of connection of the ends 514*a* and 514*b* of the segments 512*a* and 512*b* are not a part of the present invention.

Referring now to FIGS. 8 and 10, the antenna-mounting ring 292 includes first and second arcuate segments 516*a* and 516*b*, each having first and second ends 518*a* and 518*b*. The arcuate segments 516*a* and 516*b* are positioned around the tower 12 with the first ends 518*a* abutting the second ends 518*b*; and the arcuate segments 516*a* and 516*b* are interconnected by any suitable means. The detailed method of interconnecting the arcuate segments 518*a* and 518*b* is not a part of the present invention.

Referring now to FIGS. 2, 5, 8 and 10, the arcuate segments 512*a* and 512*b* each include arcuate surfaces 524*a* and 524*b*, and the arcuate segments 516*a* and 516*b* each include arcuate surfaces 526*a* and 526*b*.

The upper circumferential surfaces, 152 or 302, each include one arcuate surface, 524*a* or 526*a*, on each of the respective ones of the arcuate segments, 512*a* and 512*b*, or 516*a* and 516*b*; and the lower circumferential surfaces 154 or 304 each include one arcuate surface, 524*b* or 526*b*, on each of the respective ones of the arcuate segments 512*a* and 512*b*, or 516*a* and 516*b*.

The arcuate segments 512*a* and 512*b*, each include an opening, 530*a* or 530*b*, that is disposed radially inward of an arcuate surface, 524*a* or 524*b*, and that opens outward between the ends, 514*a* and 514*b*, of respective ones of the arcuate segments 512*a* and 512*b*. In like manner, the arcuate segments 516*a* and 516*b* each include a similar opening (not shown) that is disposed radially inward of an arcuate surface, 526*a* or 526*b*, and that opens outward between the ends, 518*a* or 518*b*, of respective ones of the arcuate segments, 516*a* and 516*b*.

Preferably, all of the segments and rings are disposed about a vertical axis or segment axis 26 that is parallel to the neutral axis 24 of the antenna tower; so all of the segments and rings are disposed in a plane 532 that is orthogonal to the neutral axis 24; and so the circumferential surfaces 152, 154, 302, and 304 are disposed circumferentially around the axis 26. The ring 142 includes a tower-receiving or tower-accepting opening 548 that includes the openings 530*a* and 530*b* of the arcuate segments 512*a* and 512*b*. In like manner, the ring 292 includes a tower-receiving opening (not shown) that includes both of the openings (not shown) of the arcuate segments 516*a* and 516*b*.

Referring again to FIG. 2, the antenna tower 12 includes three faces 534*a*–534*c* which comprise a side of the tower 12 that is disposed between any adjacent two of the tower legs 20*a*–20*c*. Thus, in broadest terms, the rotationally positionable mounts 504 and 506 are attached to a face 534a–534c of the tower 12, as opposed to being attached to a top (not shown) of the tower 12.

In the embodiment of FIGS. 2–7, the first mounting portion includes two of the support housings 170 and the support housing 204; and the antenna-mounting ring 292 is the second mounting portion.

In like manner, in the embodiment of FIGS. 8–10, the first mounting portion includes two of the support housings 342 and the support housing 328.

In the embodiment of FIGS. 2–7, the first and second mounting portions are interconnected by attaching a support roller 166 to each of the support housings 170 and by attaching a support roller 219 to the support housing 204.

In the embodiment of FIGS. 8–10, the support rollers 306 are frustoconical in shape and include a large diameter end 460 that is adjacent to the roller shaft 310, and a small diameter end 462. In like manner, the drive pinion 372 includes a large diameter end 464 that is adjacent to the shaft 366, and a small diameter end 466.

Referring finally to FIGS. 2–7 and 8–10, if the antennas 256 and 384 and the wind vane 268 are deleted from the tower and rotationally positionable mount assemblies 140 and 290, then the assemblies become tower and rotationally positionable mount assemblies 538 and 540.

In summary, the present invention provides means for rotatably mounting one or more search devices to the face of a tower. The search devices which may be mounted include radio antennas, video cameras, and searchlights.

The present invention includes two embodiments wherein a search-device mounting ring is rotatably attached to the three tower legs of the tower by a roller that is operatively attached to each tower leg and that engages a groove in the search-device mounting ring.

In one of these embodiments, the roller shafts are vertically disposed and are both radially and circumferentially disposed about a vertical axis.

This vertical axis is preferably the neutral axis of the tower, but it may be any vertical axis that is disposed radially inside the tower legs and truss bracing of the tower.

In the other of these two embodiments, the roller shafts are disposed both orthogonally and radially with respect to a vertical axis.

The present invention includes: roller and groove means for supporting, guiding, and stabilizing the search-device mounting ring, counterbalance means for counterbalancing the weight of a search device, torsional wind balance means for counteracting torsional wind loads that are applied to the tower by the search device, electrical means for rotating the search device, means for electrically heating and thus thawing ice from the antenna-mounting ring and gear teeth, and apparatus and method for assembling the antenna-mounting rings about the antenna tower at any convenient height.

The support rollers cooperate with a first circumferential surface to support a ring-shaped mounting portion, cooperate with a second circumferential surface to vertically restrain the ring-shaped mounting portion and thereby to prevent tilting of the ring-shaped mounting portion, and cooperate with one of the mounting portions to radially guide the ring-shaped mounting portion, as shown in FIGS. 2, 5, 6, 8, and 9.

The support rollers each include a roller shaft; and respective ones of the support rollers are supported, vertically restrained, and radially restrained by operative attachment of the respective ones of the roller shafts to another mounting portion, as shown in the drawings.

The present invention provides apparatus and method for mounting a plurality of antennas, or search devices, to a single tower, and for separately rotating, or rotationally positioning, the antennas or search devices. Therefore, the present invention provides functional advantages over prior art systems wherein only one antenna can be rotated, and economic advantages over prior art systems wherein multiple towers are required.

Further, the present invention allows the use of larger antennas on a given size of tower, the use of a larger number of antennas on a given size of tower, or the use of a tower of smaller cross-sectional dimensions and less torsional rigidity for a given number of antennas of a given size; because all of the embodiments of the present invention apply torsional loads equally to all of the tower legs, and because of the torsional wind balance that is provided by the use of wind vanes.

INDUSTRIAL APPLICABILITY

The present invention provides apparatus and methods for the rotatable mounting and both separate and selective rotational positioning of a plurality of antennas or search devices on a single tower.

The present invention may be used by homeowners for mounting and rotating of antennas of the types used for receiving video signals, for broadcasting and receiving of citizens band radio signals, and for receiving both AM and FM radio signals.

The present invention may be used by radio amateurs for both broadcasting and receiving antennas, by commercial radio stations, by microwave transmission companies, and by the military forces for radio communications.

In addition, the present invention may be used to mount and separately rotate such search devices as directional receiving antennas, video cameras, and searchlights in such numbers or combinations as are needed.

What is claimed is:

1. A tower and rotationally positionable mount assembly (538 or 540) which comprises a tower (12) having three tower legs (20a–20c), having bracing (22) intermediate of adjacent pairs of said legs that defines a plurality of faces (534a–534c) of said tower, and having a neutral axis (26) that is disposed intermediate of said faces;

a first mounting portion comprising first (170 or 342), second (170 or 342), and third (204 or 328) support housings that are separately attached to respective ones of said tower legs;

a second mounting portion (142 or 292) being disposed circumferentially around said three tower legs, and having a first (152 or 302) circumferential surface that circumscribes said three tower legs, and that is disposed around an axis (24) substantially parallel to said neutral axis;

first, second, and third roller shafts (182, 188, 218, 310, or 334) being operatively attached to respective ones of said housings;

first, second, and third rollers (160, 186, 219, or 308) being operatively attached to respective ones of said roller shafts, and having roller surface means (164+166, 194+196, or 320) for cooperating with said first circumferential surface;

attaching means, comprising said rollers, and comprising said first circumferential surface, for supportingly attaching said second mounting portion to said first mounting portion by operative engagement of said roller surface means with said first circumferential surface, for vertically restraining said second mounting portion, and for radially guiding said second mounting portion; and means (214+220+158, 214+194+152, or 360+372+370) for rotationally positioning said second mounting portion with respect to said first mounting portion.

2. A tower and rotationally positionable mount assembly (538) a claimed in claim 1 in which each mount assembly includes a second (154) circumferential surface;

said roller surface means comprises first (164 or 194) and second (166 or 196) roller surfaces on each of said rollers (160, 186, or 219);

said operative engagement of said roller surface means with said first circumferential surface (152) comprises operative engagement of said first roller surfaces with said first circumferential surface; and said vertical restraining of said second mounting portion means comprises close proximity of said second roller surfaces to said second circumferential surface.

3. A tower and rotationally positionable mount assembly (538) as claimed in claim 2 in which said assembly includes means for adjusting said close proximity.

4. A tower and rotationally positionable mount assembly (538) as claimed in claim 3 in which said means for adjusting said close proximity comprises rotationally positioning one (170 or 204) of said support housings about one (20*a*–20*c*) of said tower legs.

5. A tower and rotationally positionable mount assembly (538 or 540) as claimed in claim 1 in which said mount assembly includes a second circumferential surface (154 or 304);

said vertical restraining of said second mounting portion means comprises close proximity of said second circumferential surface (154) to said roller surface means; and said mount assembly includes means for adjusting said close proximity.

6. A tower and rotationally positionable mount assembly (540) as claimed in claim 5 in which said means for adjusting said close proximity comprises positioning one (308) of said rollers radially with respect to one (20*a*–20*c*) of said tower legs.

7. A tower and rotationally positionable mount assembly (540) as claimed in claim 5 in which said means for adjusting said close proximity comprises positioning one (308) of said rollers radially with respect to one (342) of said housings.

8. A tower and rotationally positionable mount assembly (538) as claimed in claim 5 in which said means for adjusting said close proximity comprises means (230), being disposed partially inward of said faces (534*a*–534*c*) of said tower (12), for adjustably controlling spacing between said three (170+170+204) housings.

9. A tower and rotationally positionable mount assembly (538) as claimed in claim 5 in which said assembly includes means (246) for resiliently urging said roller surface means (164+166) into contact with said second (154) circumferential surface; and said close proximity of said roller surface means with said second circumferential surface comprises said contact of said roller surface means with said second circumferential surface.

10. A tower and rotationally positionable mount assembly (538 or 540) as claimed in claim 1 in which said second mounting portion (142 or 292) includes first (512*a* or 516*a*) and second (512*b* or 516*b*) segments;

said first segment includes a first (524*a* or 526*a*) arcuate surface, and includes a first opening (530*a*) that is disposed radially inward of said first arcuate surface, and that opens outwardly from said first segment distal from said first arcuate surface;

said second segment includes a second (524*a* or 526*a*) arcuate surface, and a second opening (530*b*) that is disposed radially inward of said second arcuate surface, and that opens outwardly from said second segment distal from said second arcuate surface; and said first (152 or 302) circumferential surface includes said first and second arcuate surface.

11. A tower and rotationally positionable mount (538 or 540) as claimed in claim 1 in which means for rotationally positioning comprises a drive motor (214 or 360) being operatively attached to one (204 or 328) of said housings and operatively engaging said second (142 or 292) mounting portion.

12. A tower and rotationally positionable mount (538 or 540) as claimed in claim 11 in which said operative engagement of said drive motor (214 or 360) with said second (142 or 292) mounting portion comprises a drive pinion (220 or 370) being operatively connected to said drive motor, a plurality of circumferentially disposed gear teeth (158 or 370) on said second mounting portion, and progressive engagement of said drive pinion with said circumferentially disposed gear teeth.

13. A tower and rotationally positionable mount (538) as claimed in claim 11 in which said operative engagement of said drive motor (214) with said second (142) mounting portion comprises a friction drive element (186) being operatively connected to said drive motor, and friction engagement of said friction drive element with said second mounting portion.

14. A rotationally positionable mount (504 or 506) for mounting a device (256, 266, or 384) to a face (534*a*–534*c*) of a tower (12) of the type having vertically disposed tower legs (20*a*–20*c*) and having a plurality of faces intermediate of adjacent pairs of said tower legs, which mount comprises first mounting portion means, including first (170 or 342), second (170 or 342), and third (204 or 328) support housings, for attachment to respective ones of said tower legs;

second mounting portion means (142 or 292), comprising a tower-receiving opening (548), and comprising a first (152 or 154) circumferential surface that circumscribes said tower-receiving opening, for mounting said device thereto, and for circumscribing all of said tower legs;

first, second, and third roller shafts (182, 188, 218, 310, or 334) being operatively attached to respective ones of said support housings;

first, second, and third rollers (160, 186, 219, or 308) being operatively attached to respective ones of said roller shafts, and each having roller surface means (164+166, 194+196, or 320) for cooperating with said first circumferential surface;

attaching means, comprising said rollers, and comprising said first circumferential surface, for supportingly attaching said second mounting portion to said first mounting portion by operative engagement of said roller surface means with said first circumferential surface, for vertically restraining said second mounting portion, and for radially guiding said second mounting portion; and means (214+220+158, 214+194+152, or 360+372+370) for rotationally positioning said second mounting portion with respect to said first mounting portion.

15. A rotationally positionable mount (504 or 506) as claimed in claim 14 in which said mount (504 or 506) includes a second (154 or 304) circumferential surface;

said roller surface means comprises first (164 or 194) and second (166 or 196) roller surfaces on each of said rollers (160, 186, or 219);

said operative engagement of said roller surface means with said first circumferential surface comprises operative engagement of said first roller surfaces with said first circumferential surfaces; and said vertical restraining of said second mounting portion means (142 or 292) comprises close proximity of said second roller surfaces to said second circumferential surface.

16. A rotationally positionable mount (504 or 506) as claimed in claim 14 in which said second mounting portion (142 or 292) includes first (512*a* or 516*a*) and second (512*b* or 516*b*) segments;

said first segment includes a first (524*a* or 526*a*) arcuate surface, and includes a first opening (530*a*) that is disposed radially inward of said first and second arcuate surfaces, and that opens outwardly from said first segment distal from said first arcuate surface;

said second segment includes a second (524*a* or 526*a*) arcuate surface, and a second opening (530*b*) that is disposed radially inward of said second arcuate surface, and that opens outwardly from said second segment distal from said second arcuate surface; and said first (152 or 302) circumferential surface includes said first and second arcuate surfaces.

17. A method for mounting a device (256, 266, or 384) to a vertically-disposed tower (12) having three tower legs (20*a*–20*c*), having bracing (22) intermediate of pairs of said legs that defines faces (534*a*–534*c*) of said tower, and having a neutral axis (26) that is disposed intermediate of said faces, and for rotationally positioning said device, which method comprises:

(a) attaching first (170 or 342), second (170 or 342), and third (204 or 328) support housings to separate ones of said tower legs;

(b) operatively attaching a roller shaft (182, 188, 218, 310, or 334) to each of said support housings;

(c) operatively attaching a roller (160, 186, 219, or 306) to each of said roller shafts;

(d) placing a device-attaching portion (142 or 292) circumferentially around said tower legs;

(e) supportively engaging said device-attaching portion with said support rollers;

(f) operatively attaching a drive motor (214 or 360) to one (204 or 328) of said support housings; and (g) operatively engaging (220+158, 194+152, or 372+370) said drive motor with said device-attaching portion.

18. A method as claimed in claim 17 in which said placing step comprises:

(a) moving a first arcuate segment (512*a* or 516*a*) orthogonally toward said tower (12) and into an arcuate relationship to said tower;

(b) moving a second arcuate segment (512*b* or 516*b*) orthogonally toward said tower, into an arcuate relationship to said tower, and into a tower-encircling relationship with said first arcuate segment; and (c) interconnecting said arcuate segments into said device-attaching portion (142 or 292).

19. A method as claimed in claim 17 in which said operative engaging step comprises:

(a) defining a plurality of circumferentially-disposed gear teeth (158 or 370) on said device-attaching portion (142 or 292);

(b) operatively connecting said drive motor (214 or 360) to a toothed drive pinion (220 or 372);

(c) meshing said toothed drive pinion with said circumferentially-disposed gear teeth.

20. A method as claimed in claim 17 in which said operative engaging step comprises:

(a) operatively connecting said drive motor (214) to a friction drive element (186); and (b) providing friction engagement between said friction drive element and said device-attaching portion (142).

* * * * *